United States Patent [19]

Rowley et al.

[11] 4,007,837

[45] Feb. 15, 1977

[54] BOTTOM EDGE SUPPORT FOR AN ARTICLE SHIPPING RACK

[75] Inventors: James R. Rowley, Freeport; Stephen R. Sokol, Cheswick, both of Pa.

[73] Assignee: PPG Industries, Inc., Pittsburgh, Pa.

[22] Filed: Oct. 1, 1975

[21] Appl. No.: 618,607

[52] U.S. Cl. ..... 206/448; 105/367; 206/454; 214/10.5 R; 248/119 R

[51] Int. Cl.[2] ..... B65D 5/48

[58] Field of Search ..... 206/448, 449, 451, 453, 206/454, 386; 214/10.5 R; 105/367, 392.5, 474, 486, 496; 248/119 R

[56] References Cited

UNITED STATES PATENTS

| | | | |
|---|---|---|---|
| 3,147,860 | 9/1964 | Kean, Sr. et al. | 206/448 |
| 3,533,502 | 10/1970 | Hansen | 206/386 |
| 3,623,688 | 11/1971 | Ansund | 248/119 R |
| 3,658,011 | 4/1972 | West et al. | 105/367 |
| 3,809,234 | 5/1974 | Kurick | 206/448 |
| 3,863,799 | 2/1975 | Thomaswick et al. | 206/448 |
| 3,878,942 | 4/1975 | Hansen et al. | 206/454 |
| 3,938,660 | 2/1976 | Moehring | 206/451 |
| 3,939,780 | 2/1976 | Bundy | 206/451 |

*Primary Examiner*—William Price
*Assistant Examiner*—Bruce H. Bernstein
*Attorney, Agent, or Firm*—Donald Carl Lepiane

[57] ABSTRACT

A rack for shipping articles, e.g., automotive windshields has a pair of bottom edge supports pivotally mounted in spaced relation on the base to support the articles on an edge.

10 Claims, 3 Drawing Figures

BOTTOM EDGE SUPPORT FOR AN ARTICLE SHIPPING RACK

RELATED APPLICATIONS

The pivotal bottom edge support of this invention may be used with the shipping rack taught in U.S. patent application Ser. No. 618,609 filed even date in the names of Walter E. Pater and James R. Rowley and entitled "Nestable Article Shipping Racks Having Pivotal Mounted End Restraints". The teachings of the above-identified application are hereby incorporated by reference.

BACKGROUND OF THE INVENTION

1. Field of the Invention

This invention relates to pivotal and slideable bottom edge supports for article shipping racks.

2. Discussion of the Prior Art

Articles, e.g., automotive lites such as windshields or backlites, are shipped in racks in a generally vertical position with the bottom edge of the articles supported on rubber bottom edge supports mounted on the base of the rack. Examples of shipping racks are taught in U.S. Pat. Nos. 3,533,502 and 3,809,234.

During shipment of the automotive windshields, maximum surface contact between the article edge and the bottom edge support is desired. This is because a mismatch between the curvature of the support edge of the article and the bottom edge support sets up point contact stress that can cause the windshields to fracture during shipping or handling of the loaded rack. Further, during shipment, transportation forces act to move the articles along a longitudinal path parallel to the backwall against end restraints. When there is only point contact between the article edges and the bottom edge supports, there is little or no frictional forces acting on the article edges to counteract the longitudinal transportation forces.

In the prior art, the above problems could be overcome by providing bottom edge supports having a surface curvature to match the peripheral edge contour of the articles to be shipped. This is expensive because different types of bottom edge supports have to be stored and mounted on the base of the rack for each change of article configuration.

In U.S. Pat. No. 3,519,244, there is taught a wooden shipping crate having a support for supporting the articles at their major surfaces. In general, the support includes an outer shell, main frame and inner support elements, each of which is formed from a rectangular piece of corrigated cardboard by providing a series of integral, flexible hinge lines in the rectangular sheets and by attaching a portion of the outer shell to the main frame. This type of edge support is not reusable and therefore is not of the type recommended for returnable article shipping racks. Further because the supports are made of cardboard they are not readily adaptable for supporting articles at their edges. This is because the edges of the articles cut into the cardboard supports collapsing them.

It would be advantageous therefor if a bottom edge support for returnable shipping racks was available that could be used with articles having different peripheral contours while providing maximum surface contact to eliminate point contact stress and to increase frictional engagement between the articles and the bottom edge supports to minimize longitudinal movement of the articles during shipping.

SUMMARY OF THE INVENTION

This invention relates to an improved rack for shipping articles, e.g., automotive windshields. The rack is of the type having a backwall secured to a base and edge supports mounted on the base for supporting the articles on an edge. The improvement includes each of the edge supports having a rigid member pivotally mounted on the base for pivotal movement about a line normal to the backwall.

In an alternate embodiment of the invention, the rigid member is also slideably mounted for movement toward and away from the backwall of the rack.

DESCRIPTION OF THE INVENTION

This invention relates to a bottom edge support for use in a rack for shipping articles, e.g., sheets, glass sheets, automotive side lites, automotive backlites or automotive windshields.

As will become apparent, the invention may be practiced on any type of article shipping rack and is preferably used with racks of the type made of steel tubing and are returnable for subsequent article shipments. For example, the bottom edge supports of the instant invention may be used on the article shipping racks disclosed in U.S. patent application Ser. No. 371,912 filed on June 20, 1973, in the names of James R. Rowley and Walter E. Pater and entitled "Method of and Device for Restraining Movement of Articles During Transit", U.S. Patent application Ser. No. 488,851 filed on July 15, 1974 now U.S. Pat. No. 3,963,122 filed, in the names of Walter E. Pater and James R. Rowley and entitled "Front Restraint Device for Shipping Bins", and in U.S. Pat. No. 3,887,071. The teachings of the above-identified patent applications and patent are hereby incorporated by reference.

Figure 1:
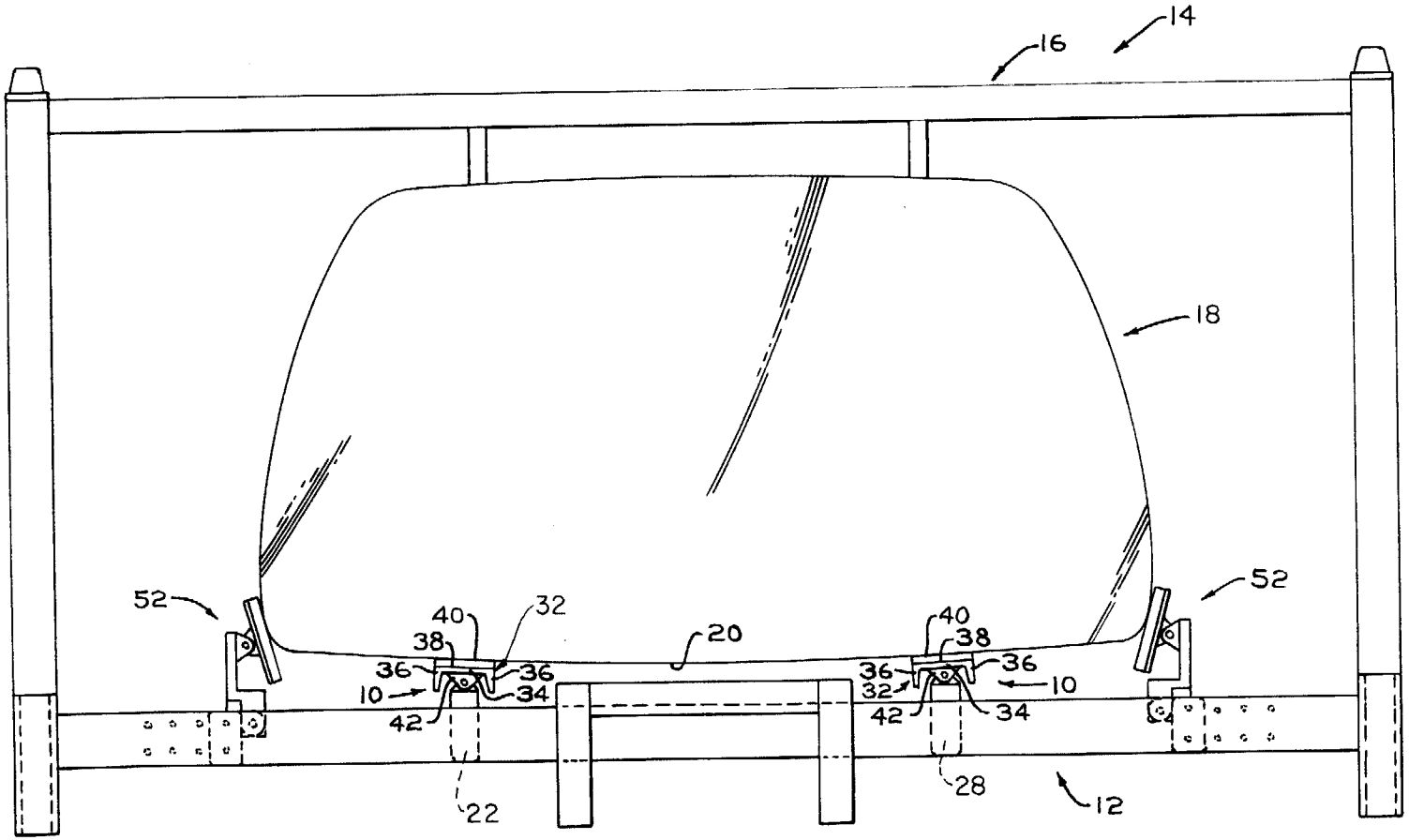
FIG. 1 is a front elevated view of a shipping rack loaded with automotive windshields and having bottom edge supports of the invention mounted on the base for supporting an edge of the article.
Figure 2:
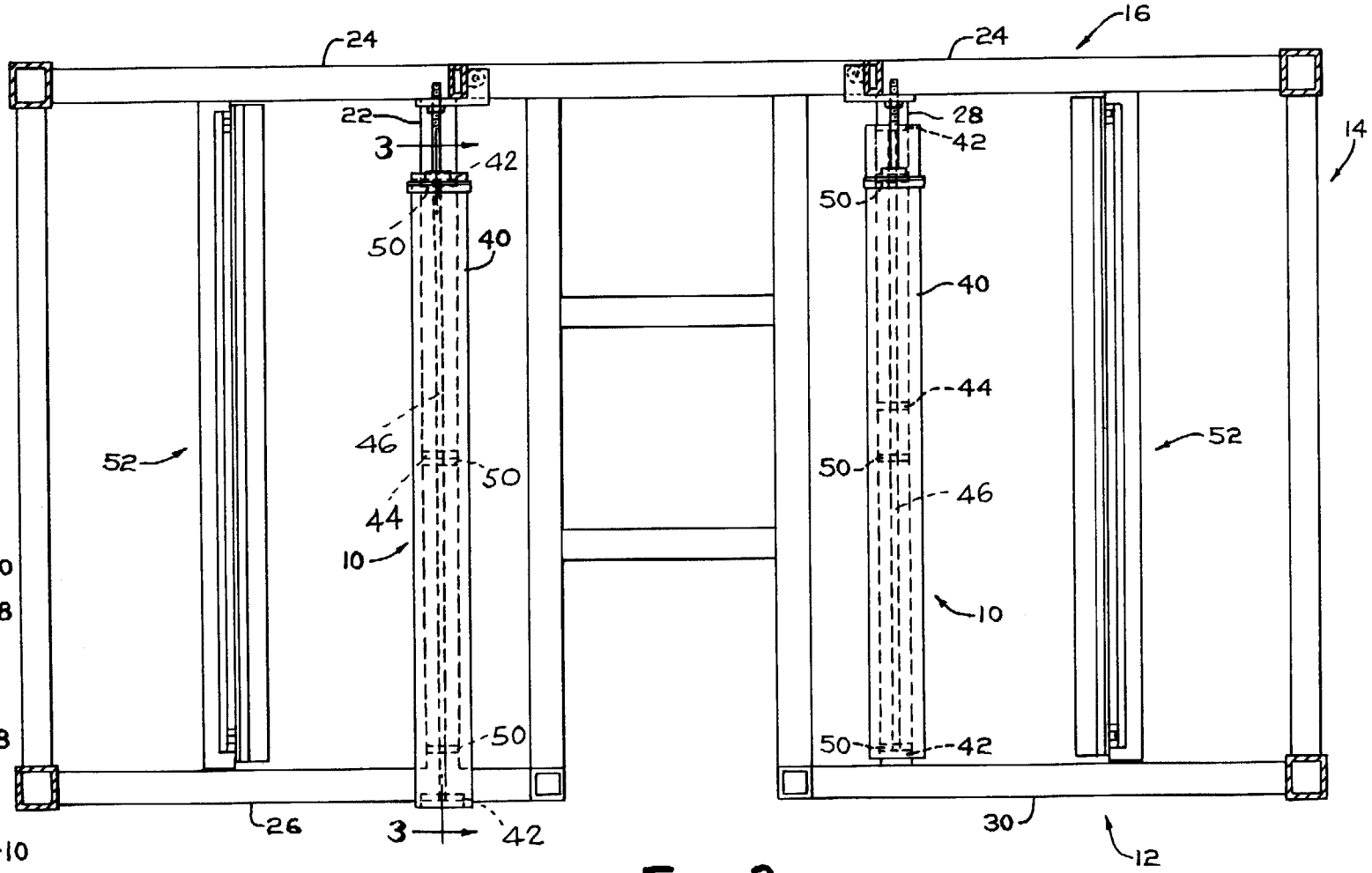
FIG. 2 is a top view of the shipping rack of FIG. 1 having the windshields removed and having portions removed for purposes of clarity.

With reference to FIGS. 1 and 2, bottom edge supports 10 of the invention are pivotally and slideably mounted on base 12 of an article shipping rack 14 in a manner to be discussed below. The article shipping rack 14 is of the type taught in U.S. patent application Ser. No. 618,609 filed even date in the names of Walter E. Pater and James R. Rowley and entitled "Nestable Article Shipping Rack Having Pivotal Mounted End Restraints" which teachings are hereby incorporated by reference. The shipping rack 14 includes a backwall 16 secured to the base 12 to support articles 18 on a bottom edge 20 by way of the bottom edge supports 10 and tilted toward the backwall, i.e., in a generally vertical position.

For a detailed description of the rack 14 reference may be had to the above-identified U.S. patent application filed even date.

As viewed in FIG. 2, the rack 14 includes right and left bottom edge supports 10 which are identical in construction. The left bottom edge support is pivotally mounted on a lateral cross member 22 having its ends secured to lower longitudinal cross member 24 and left front longitudinal cross member 26 of the base 12 and the right bottom edge support is pivotally mounted on lateral cross member 28 having its ends secured to the lower longitudinal cross member 24 and right front longitudinal cross member 30.

The discussion will be directed to the left bottom edge support with the understanding that the discussion is applicable to the right bottom edge support, as shown in FIG. 2, unless indicated otherwise.

Figure 3:
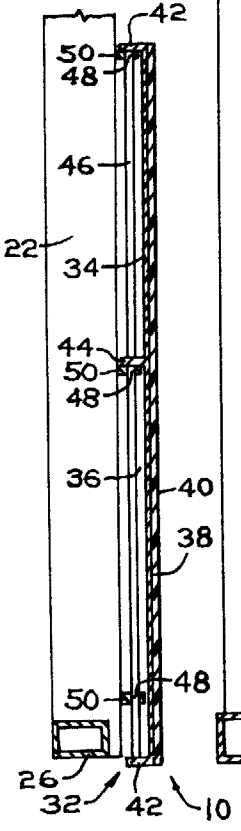
FIG. 3 is a view taken along lines 3—3 of FIG. 2.

With reference to FIGS. 1, and 3, the edge support 10 includes a pivotally and slideably mounted, inverted, rigid U-shaped member 32 having an intermediate leg 34 and two outer legs 36. By way of illustration the member 32 may be a ¼ inch (0.64 centimeter) thick C3×4.1 channel American Standard. Surface 38 of the intermediate leg has a resilient pad 40, e.g., a rubber pad having a durometer reading of between about 50–80 to prevent marring of the edges 20 of the articles 18 supported thereby and for frictionally engaging the edges 20 of the articles 18.

The member 32 is pivotally mounted to the cross member 22 in any conventional manner. For example and also with reference to FIG. 2 a pair of end plates 42 and an intermediate plate 44 are secured to the member 32 between the outer legs 36 as shown in FIGS. 1 and 3. A rod 46 has its ends secured to the end plates 42 and passes through holes 48 of plates 50 mounted on the lateral cross member 22 and hole (not shown) in the intermediate plate 44 of the member 32 to pivotally mount the edge support 10 on the cross member 22.

In the instant where the bottom edge support 10 is to be slideably mounted for nesting racks as taught in the above-mentioned application filed even date, the plates 42 and 44 of the member 32 and plates 50 on the cross member 22 are selectively positioned to permit sliding of the bottom edge support toward and away from the backwall of the rack, i.e., reciprocal lateral motion. For example, in the instance where the member 32 has a length of 37 inches (0.94 centimeter) and the end of the bottom edge support adjacent the backwall is to be spaced therefrom 4.5 inches (11.43 centimeters), the plates 42 are secured to the end of the member 32 and the intermediate plate 44 is spaced about 16 inches (40.64 from centimeters) the plate 42 adjacent the backwall 16. The plates 48 mounted on the cross member are spaced 4-½ inches (11.43 centimeters); 20-½ inches (52.07 centimeters); and 36-½ inches (92.71 centimeters) respectively, from inside surface of the backwall 16.

The thickness of the plates 42, 44 and 48 and diameter of the rod 46 are not limiting to the invention but should be of sufficient thickness to support the articles during shipment and handling. Steel plates having a thickness of about ¼ inch (0.63 centimeter) and a steel rod having a diameter of about ½ inch (1.27 centimeters) are acceptable for loads up to 1500 pounds (0.68 metric ton).

When the rack is loaded, the edge 20 of the articles 18 is positioned on the rubber pad 40. The channel member 32 pivots relative to the base to adjust to the contour of the supported portion of the edge 20. The edge 20 of the article is further seated in the rubber pad 40 to provide maximum surface contact between the supported portion of the edge 20 and the rubber pad 40.

With the instant invention, a bottom edge support is provided to match the contour of the supported edge of the articles. In this manner, point contact stress are eliminated and increase frictional engagement between the article edge 20 and the bottom edge supports is provided.

Eliminating point contact stress, reduces or eliminates the occurrences of fractures at the supported edge of the articles during shipping or handling. Increasing frictional engagement between the bottom edge supports and the article edges operate to counteract longitudinal forces during transit or handling which tend to slide the article along a reciprocating longitudinal path parallel to the backwall against end restraints 52 (see FIG. 1). In this manner, the impact forces of the articles as they move into engagement with end restraints is reduced to minimize edge fracture of the articles.

As can be appreciated, modifications of the bottom edge support within the scope of the invention can be made. For example, the U-shaped channel member 32 may be replaced with a flat rigid member.

Further, the invention is not limited to the embodiments of the discussion and are presented to illustrate the invention.

What is claimed is:

1. In a rack for shipping sheets wherein the rack is of the type having a backwall secured to a base; edge supports securely mounted on the base for supporting the sheets on edge in a generally vertical position; and end restraints to prevent longitudinal movement of the sheets, the improvement comprising:

each of the edge supports, comprising: a rigid elongated member having a first end and an opposite second end; and means for pivotally mounting said member on the base about a line generally normal to the backwall and parallel to the base with the first end of said member adjacent the backwall.

2. The improved shipping rack as set forth in claim 1 wherein a resilient pad is mounted on sheet supporting surface of said member.

3. The improved sheets shipping rack as set forth in claim 2 wherein the articles are made of glass.

4. The improved shipping rack as set forth in claim 1 wherein said pivotally mounting means further includes means for slideably mounting said elongated member to move toward and away from the backwall.

5. The improved shipping rack as set forth in claim 1 wherein said rigid member is an inverted U-shaped channel.

6. The improved shipping rack as set forth in claim 5 wherein said pivotally mounting means further includes means for slideably mounting said U-shaped channel to move toward and away from the backwall.

7. The improved shipping rack as set forth in claim 6 wherein a resilient pad is mounted on upper surface of intermediate leg of said channel.

8. The shipping rack as set forth in claim 7 wherein the sheets are automotive lites.

9. The improved shipping rack as set forth in claim 7 wherein said pivotally mounting means includes:

a first at least one plate member mounted on said channel in spaced relationship to the base;

a second at least one plate member mounted on the base in spaced relationship to said channel; and a rod passing through said first and second at least one plate member to pivotally and slideably mount said channel on the base.

10. The improved shipping rack as set forth in claim 9 wherein the base includes a pair of spaced, rigid lateral members and a one of said channels is pivotally and slideably mounted on each of said rigid lateral members.

* * * * *